United States Patent [19]

Templet

[11] Patent Number: 4,971,364

[45] Date of Patent: Nov. 20, 1990

[54] LABEL-PROVIDING LOG FOR FACSIMILE TRANSMISSIONS AND METHOD

[75] Inventor: Vicki J. Templet, Wheaton, Ill.

[73] Assignee: Wallace Computer Services, Inc., Hillside, Ill.

[21] Appl. No.: 451,774

[22] Filed: Dec. 18, 1989

[51] Int. Cl.[5] ..... B42D 15/00

[52] U.S. Cl. ..... 283/70; 283/52.1; 283/61; 283/81; 283/101; 283/9 R; 283/DIG. 2

[58] Field of Search ..... 283/67, 70, 94, 95, 283/100, 101, 105, 900, 901, 60.2, 61, 63.1, 81, 48.1, 49, 50, 51, 52, 52.1; 282/3 R, 8 R, 9 R, 12 R, 22 R, 23 R, 26, 27 R

[56] References Cited

U.S. PATENT DOCUMENTS 4,121,961 10/1978 Brunette et al. ..... 283/81
4,190,268 2/1980 Webster ..... 283/901
4,583,765 4/1986 Messinger ..... 282/9 R
4,798,401 1/1989 Greig ..... 282/22 R
4,811,973 3/1989 Kumar-Misir ..... 281/27.2

OTHER PUBLICATIONS

A film log system from a local film shop.

*Primary Examiner*—Paul A. Bell
*Assistant Examiner*—Hwei-Siu Payer
*Attorney, Agent, or Firm*—Tilton, Fallon, Lungmus & Chestnut

[57] ABSTRACT

A label-log having pairs of sheets wherein the upper sheet has peelable labels and the two sheets constituting a carbonless system whereby information indicia as to sender, recipient, date and the like when entered on the upper sheet is permanently recorded on the lower sheet.

2 Claims, 1 Drawing Sheet

FIG. 1
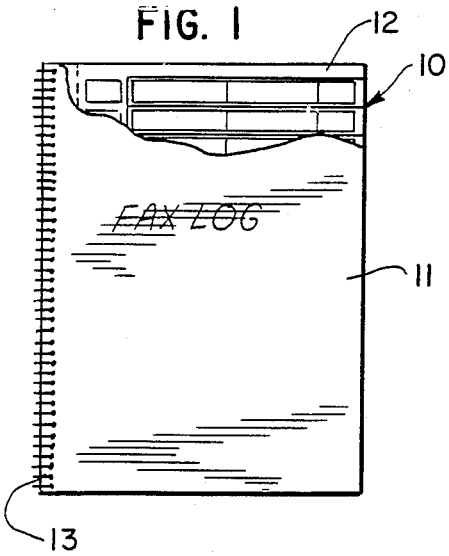
FIG. 2
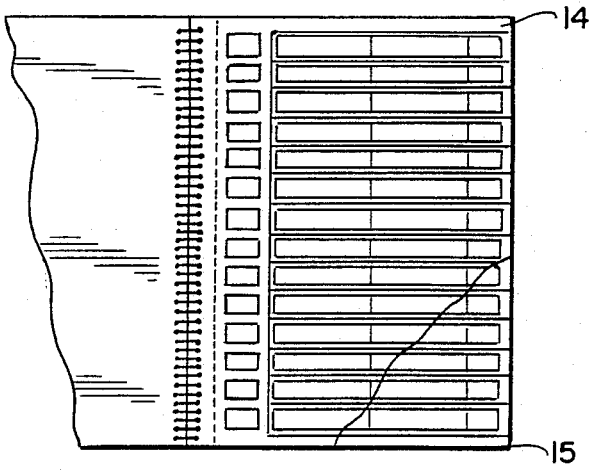
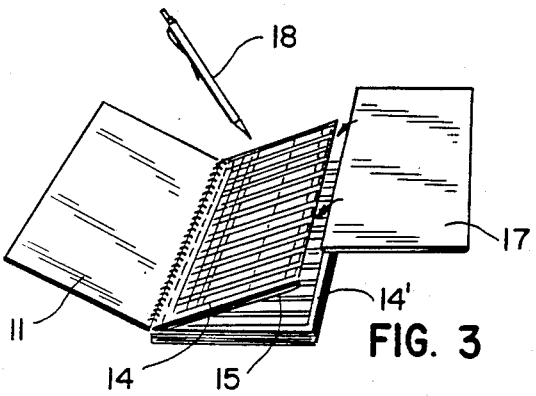
FIG. 3
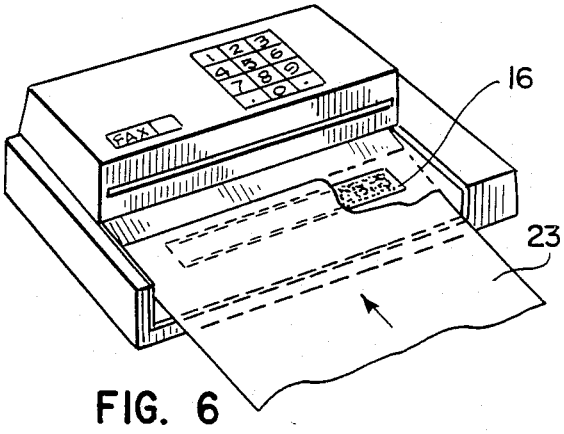
FIG. 6
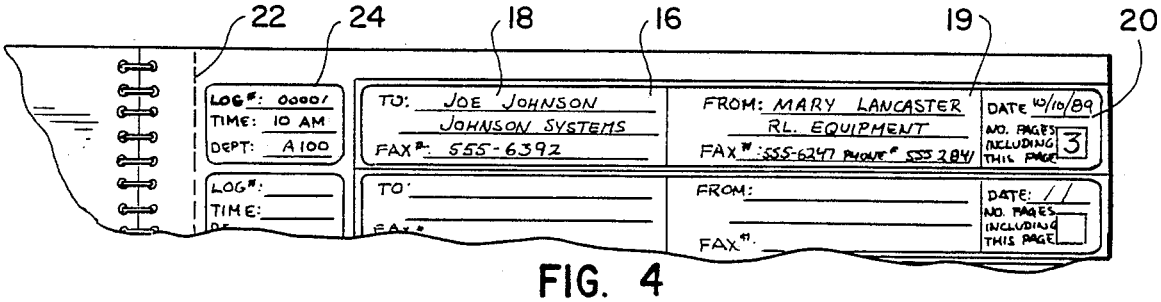
FIG. 4
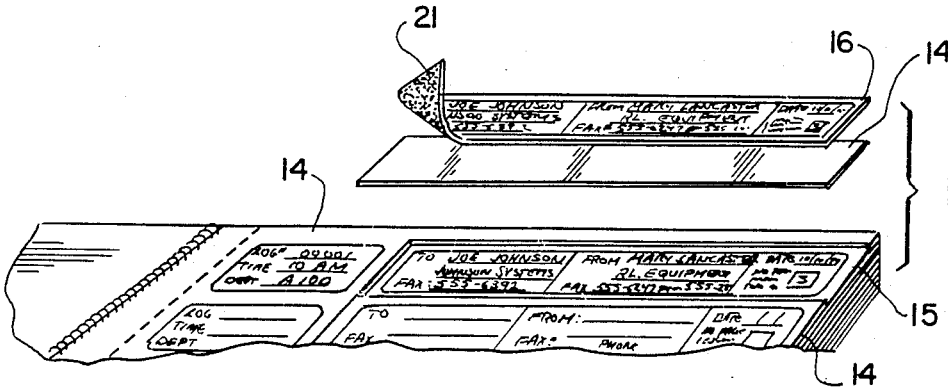
FIG. 5

LABEL-PROVIDING LOG FOR FACSIMILE TRANSMISSIONS AND METHOD

BACKGROUND AND SUMMARY OF INVENTION

This invention relates to label-providing log for facsimile transmissions and method and, more particularly, to a bound volume of paired superposed sheets which creates a log as information is entered on a detachable routing label.

With the tremendous increase in facsimile transmissions —normally referred to as "fax"messages—there has arisen a problem of record control. This is solved through the practice of the invention as well as providing a conveniently accessible paste-on label which eliminates the cost of sending a cover sheet and saves fax paper.

The invention, in its log aspect, includes a plurality of paired superposed sheets bound along one side to form a permanent log. The lower of each pair of sheets is constructed of self-contained paper so that printing or writing on the upper sheet carries through the lower sheet to present an image on the lower of the pair of sheets. The upper sheet of each pair has on its upper surface a release liner and above the release liner a plurality of labels equipped with pressure sensitive adhesive in contact with the release liner. These labels are identical and bear identifying indicia for fax transmission which includes the recipient, the sender, facsimile numbers of both, the date and the number of pages to be transmitted.

Other objects, advantages and details of the invention can be seen in the ensuing specification.

BRIEF DESCRIPTION OF THE DRAWINGS

The invention is described in conjunction with an illustrative embodiment in the accompanying drawing, in which—

FIG. 1 is a top plan view, partially broken away, of a fax log embodying teachings of this invention;

FIG. 2 is a fragmentary top plan view of the log of FIG. 1 but with the cover open to reveal the arrangement of labels on the interior pages;

FIG. 3 is a perspective view of the inventive log in the process of being inscribed as part of the practice of the inventive method;

FIG. 4 is an enlarged fragmentary plan view of the upper portion of the log seen in FIG. 2 and with the identifying indicia set down;

FIG. 5 is a fragmentary exploded perspective view showing the parts of the label-providing upper sheet; and FIG. 6 is a fragmentary perspective view of a fax machine in the process of using a label-equipped page of correspondence according to the teachings of this invention.

DETAILED DESCRIPTION

In the illustration given and with reference first to FIG. 1, the numeral 10 designates generally the inventive fax log which is seen to include a cover 11 advantageously constructed of white coated chip board, interior sheets 12 and a spiral binding 13.

The sheets are provided in pairs as can be initially appreciated from FIG. 2 where the upper sheet of a pair is designated 14 and the lower sheet is designated 15. The same designations are employed in FIG. 5 where it will be seen that the upper sheet carries a peelable label 16 while the lower sheet 15 has imprinted thereon the same information as on the upper sheet 14. In use (referring to FIG. 3) a cardboard sheet 17 is inserted under the lower sheet so as to prevent strike-through to the next pair of sheets, the upper one of which being designated 14'. Also seen in FIG. 3 is a writing instrument such as a ballpoint pen designated 18 which is employed to enter the particulars of a fax transmission. Typical information is seen in FIG. 4 where information 24 relating to the log number, time and department is entered in a block at the extreme left and then on the label 16 information indicia relating to the recipient and his or her fax number as at 18. Also, entered on the label is information indicia as at 19 relating to the name of the sender, his or her fax number and phone number. Finally, as at 20, information indicia is entered as to the date and the number of pages including the page to be equipped with the label.

Referring now to FIG. 5, it will be seen that the label 16 is equipped on its underside with a pressure sensitive adhesive as at 21. The label 16 is peelably mounted on the upper sheet 14 and, for the purpose of illustration, a portion **14*a* has been shown in separated form from the remainder of the upper sheet 14. The upper sheet 14** is constructed of paper having a release coating, generally a silicone, on its upper surface.

In the illustration given, the upper sheet 14 has releasably secured thereto fourteen labels and, when the labels have all been used, the sheet 14 can be detached via a line of perforation 22, and thrown away. It will be appreciated that all of the information entered on the various labels will have carried through to the lower sheet 15 which constitutes the permanent log. A permanent log is advantageous in providing a readily accessible, chronological record of fax transmissions so that for accounting purposes, for example, cost can be readily ascribed as well as providing an information reservoir should a particular fax transmission need to be identified.

FIG. 6 illustrates the mode of usage wherein the label 16 which has been removed from the sheet 14 has been applied to a page of correspondence 23—typically inserted into the fax machine with the typed face positioned downwardly—for fax transmission.

EXAMPLE

As an example of the fax log 10, I provide a cover constructed of white chip board having a weight of 16 pounds per ream of 2318 square feet (in $24 \times 27\frac{1}{4}''$ sheets). Each upper sheet 14 is available from RaFlatac under Catalog designation 36 lb. Laser RP-55K lb. face, 50 lb. liner. Each of the upper (and lower) sheets 14, 15 are sized $8\frac{1}{4}'' \times 11''$. The lower sheets available from Appleton under designation 16 lb. self-contained white blackprint are constructed of ragless paper having a weight of 16 pounds per ream of 1298.6 square feet with the upper surface equipped with a self-contained coating. The fax log 10 is equipped with a rear cover which advantageously is constructed of uncoated chip board. The entire log or booklet advantageously contains 25 pairs of sheets which, with 14 labels per sheet, provides sufficient labels for 350 fax transmissions.

OPERATION

In the practice of the invention, a letter is typed, for example, to Joe Johnson and then the particulars at the block 24 and the other blocks 18–20 filled in by the person in charge of fax transmission. The label 16 is then peeled away from the upper sheet 14 and installed on the letter to Joe Johnson after which it is transmitted as seen, for example, in FIG. 6.

When the labels have all been removed from one upper sheet 14, the sheet may be detached by tearing along the line of perforations 22 and thrown away with a permanent record remaining on the self-contained coated lower sheet 15.

For the next transmission, the divider board 17 preventing strike-through is removed from its position under the now completed lower sheet 15 and placed under the next adjacent lower sheet.

While in the foregoing specification a detailed description of an embodiment of the invention has been set down for the purpose of illustration, many variations in the details hereingiven may be made by those skilled in the art without departing from the spirit and scope of the invention.

I claim:

1. A label-providing log for facsimile transmissions comprising a plurality of paired superposed sheets, means binding said sheets along one side to form a permanent log, the lower of each of said pair of sheets being constructed of self-contained paper so that imprinting on the upper sheet carries through to image the lower of each of said pair of sheets, each of said upper sheets having on the upper surface a release liner and above said release liner a plurality of labels equipped with pressure sensitive adhesive in contact with said release liner, said labels all being identical and bearing identifying indicia for facsimile transmission including recipient, sender, facsimile numbers thereof, date and number of pages to be transmitted, said upper sheet being equipped with a line of perforations extending adjacent said binding means for detachment of said upper sheet when all of the labels have been removed therefrom.

2. A method of recording facsimile transmission information comprising the steps of providing a booklet having pairs of superposed sheets, the upper of each of said pairs of sheets carrying peelable labels and the lower of said sheets constituting with the upper of said sheets a carbonless system whereby imprinting on the label carries through to image the lower of said sheets, imprinting indicia for facsimile transmission including recipient, sender, facsimile numbers thereof, date and number of pages to be transmitted on a label on said upper sheet, removing said label and applying the same to a piece of correspondence, facsimile transmitting said label-equipped piece of correspondence, and maintaining the lower of each of said pairs of sheets in bound relation to constitute a permanent access log record.

* * * * *